US011930886B2

(12) United States Patent
Freeman

(10) Patent No.: US 11,930,886 B2
(45) Date of Patent: Mar. 19, 2024

(54) FOOTWEAR INSOLE WITH ELECTRICAL STIMULATION

(71) Applicant: Niameh Freeman, Hurst, TX (US)

(72) Inventor: Niameh Freeman, Hurst, TX (US)

( * ) Notice: Subject to any disclaimer, the term of this patent is extended or adjusted under 35 U.S.C. 154(b) by 58 days.

(21) Appl. No.: 17/496,349

(22) Filed: Oct. 7, 2021

(65) Prior Publication Data

US 2022/0104585 A1 Apr. 7, 2022

Related U.S. Application Data

(60) Provisional application No. 63/088,794, filed on Oct. 7, 2020.

(51) Int. Cl.

| | |
|---|---|
| ***A43B 17/00*** | (2006.01) |
| ***A43B 3/00*** | (2022.01) |
| ***A43B 3/34*** | (2022.01) |

(52) U.S. Cl.

CPC ..... *A43B 17/00* (2013.01); *A43B 3/0031* (2013.01); *A43B 3/34* (2022.01)

(58) Field of Classification Search

CPC ..... A43B 17/00; A43B 3/34; A43B 3/44
USPC ..... 36/43
See application file for complete search history.

(56) References Cited

U.S. PATENT DOCUMENTS 4,578,769 A * 3/1986 Frederick ..... G04D 99/00 234/105
5,311,779 A * 5/1994 Teruo ..... G01L 1/205 73/753
2008/0282580 A1* 11/2008 Ji-Woog ..... A61F 5/14 36/140
2012/0291563 A1* 11/2012 Schrock ..... A43B 3/00 73/862.041
2017/0135417 A1* 5/2017 Lucrecio ..... G01K 13/20
2017/0348181 A1* 12/2017 Perriard ..... A43B 5/00
2018/0132566 A1* 5/2018 Rosenblatt ..... A43B 17/035
2018/0256071 A1* 9/2018 Mathieu ..... G01L 1/146
2019/0000177 A1* 1/2019 Dervish ..... A43B 7/1425
2019/0003906 A1* 1/2019 Dervish ..... A61B 5/1038
2019/0003907 A1* 1/2019 Dervish ..... G01L 1/142
2019/0289951 A1* 9/2019 Jo ..... B32B 27/065
2019/0339143 A1* 11/2019 Järvinen ..... G01L 1/146
2020/0022449 A1* 1/2020 Roberts ..... A43B 17/00
2020/0178648 A1* 6/2020 Rini ..... A43B 7/149
2020/0260815 A1* 8/2020 Cho ..... A61B 5/6807
2020/0292399 A1* 9/2020 McMillen ..... A43B 3/34
2021/0045495 A1* 2/2021 Minor ..... A61F 5/012
2021/0145622 A1* 5/2021 Riffel ..... A43B 13/186
2022/0386736 A1* 12/2022 Cho ..... A61H 23/02
(Continued)

*Primary Examiner* — Marie D Bays
(74) *Attorney, Agent, or Firm* — Law Office of Jeff Williams PLLC; J. Oliver Williams

(57) ABSTRACT

A footwear insole assembly includes individual electrodes situated within an insole configured to activate in response to applied pressure from a user's foot. The insole includes a upper surface wherein a plurality of pockets are formed in the upper surface. A plurality of pressure sensors are located in the insole and are configured to detect a compressive force on the insole. A plurality of electrodes are located within at least one of the plurality of pockets and in communication with the plurality of pressure sensors. A power supply is configured to transmit power to the plurality of electrodes in response to detected pressure from the plurality of pressure sensors.

8 Claims, 2 Drawing Sheets

(56) References Cited

U.S. PATENT DOCUMENTS

2022/0395229 A1* 12/2022 Everett ..... A61B 5/743
2022/0408872 A1* 12/2022 Chou ..... A43B 17/02

* cited by examiner

FOOTWEAR INSOLE WITH ELECTRICAL STIMULATION

CROSS REFERENCE TO RELATED APPLICATIONS

This application claims the benefit of an earlier filing date and right of priority to U.S. Provisional Application No. 63/088,794, filed 7 Oct. 2020, the contents of which is incorporated by reference herein in its entirety.

BACKGROUND OF THE INVENTION

1. Field of the Invention

The present application relates to a biomechanical stimulation device, and more particularly to a sole for footwear to selectively stimulate a user's foot.

2. Description of Related Art

Footwear brings many advantages to those who use it. Proper footwear, when worn, can prevent the growth or development of corns, ingrown toenails, fungal infections, and athlete's foot. It can help to absorb impact from walking or running which can thereby have a positive affect on spinal alignment and body posture. Despite all of these benefits, footwear can also cause problems when not properly worn or sized for the user. This amplifies the need to use proper footwear. Footwear can still be ineffective in dealing with the needs of the user in some situations. A user may experience pain in the feet or have decreased blood flow where some level of stimulation would be useful. Although strides have been made, shortcomings remain.

BRIEF SUMMARY OF THE INVENTION

It is an object of the present application to provide an insole having electrical stimulation methods. The insole is configured to include a plurality of pockets having a sensor and an electrode residing internally within the pocket. The insole is configured to detect and provide isolated electrical stimulation to pressure locations on the insole from the user's foot.

It is a further object of the present application that the insole be configured to provide stimulation individually for each pocket independent of other pockets. Additionally, a series of pockets may be configured to activate collectively from a detected pressure in a singular spot or array of spots. The interrelationship of the pockets with respect to sensing pressure and/or providing electrical stimulation can be fully independent, semi-independent of each other, or collective.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
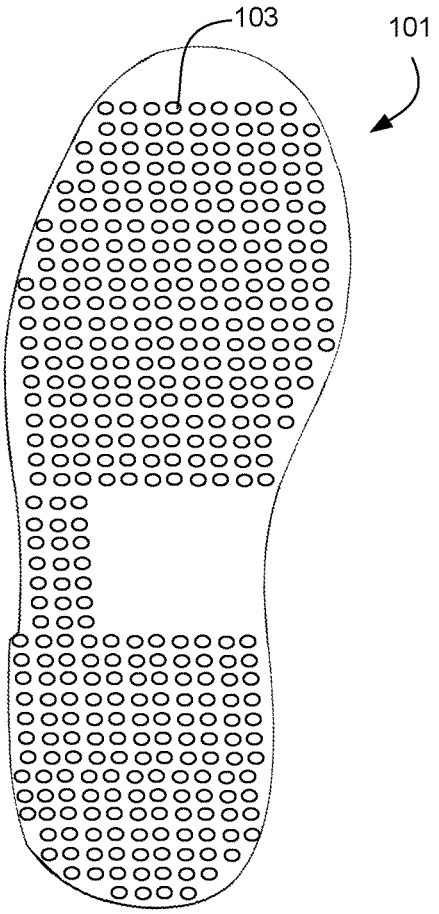
FIG. 1 is a top view of a footwear insole according to an embodiment of the present application.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE INVENTION

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The embodiments and method in accordance with the present application overcomes one or more of the above-discussed problems commonly associated with the prior art discussed previously. In particular, the insole of the present application is configured to provide isolated electrical stimulation to a user's foot in response to detected pressure. The pressure location is stimulated. An array of pockets are aligned under the foot, each pocket configured to detect and/or provide stimulation. These and other unique features are discussed below and illustrated in the accompanying drawings.

The embodiments and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

Referring now to the Figures wherein like reference characters identify corresponding or similar elements in form and function throughout the several views. The following Figures describe embodiments of the present application and its associated features. With reference now to the Figures, embodiments of the present application are herein described. It should be noted that the articles "a", "an", and "the", as used in this specification, include plural referents unless the content clearly dictates otherwise.

The footwear sole with electrical stimulation of the present application is configured to selectively provide an electrical stimulus to the foot of a user when detected pressure is applied. The system is configured in any number of ways. In general the system is integrated into the inside sole of a shoe or footwear such that it faces toward the user's foot. The system is configured to detect the application of pressure, from a foot or portion of the foot, and selectively apply the electrical stimulation to particular areas of the foot when detected. In some embodiments, a mere insert with textured pockets may be provided. In other embodiments, the textured pockets may be provided as an integrated insole.

Figure 2:
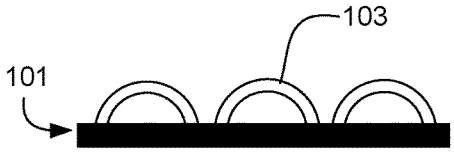
FIG. 2 is a partial enlarged side view of the footwear sole of FIG. 1.

Referring now to FIGS. 1 and 2 in the drawings, a top view of an insole 101 is provided. The insole may be integrated fully into an existing footwear or may be provided as a removable insert. The insole 101 includes one or more textured pockets 103 that are raised sections from the surface of the insole 101. These pockets 103 are arranged in selected sections of insole 101. One such arrangement may coincide with the pressure locations of the foot. In this example, areas around the arch of a foot would not necessitate pockets 103.

It is understood that these pockets 103 are configured to provide a flexible stimulus to the bottom of a user's foot and that the location of such pockets 103 is usable only where the foot contacts the insole 101, applying a compressive force to the insole. As feet have different profiles, it is known and accepted that the location of pockets 103 may be changed so as to cover any or all portions of the surface of insole 101. It may be customized to a user's particular footprint as well.

Pockets 103 are flexible in nature and used use stimulate the surface of the foot. These can assist with blood flow and decrease pain to name a few benefits. The shape of the pockets 103 are shown in a profile view in FIG. 2. In this view, pockets 103 are domed with a curved shape. The particular shape or profile of pockets 103 is not herein limited to the depicted form. Other shapes are possible. The profile of all pockets may be the same. Alternatively, the shape of two or more pockets may be different on the same insole 101.

Pockets 103 may be optionally filled with a substance to enhance performance and the stimulus effect on the foot. A substance such as a gel is possible. In other embodiments the pockets 103 may be filled with the material of the outer layer of the pocket such that no void needs filling. In this way, pockets may be completely a singular uniform material, such as silicone. Likewise, pockets 103 may be void of a filling substance.

As noted above, insole 101 may be provided as an insert to be used with any shoes or footwear. Footwear may be sandals, shoes, athletic shoes, dress shoes, boots, and so forth. A user may trim them to fit the profile of the footwear. In another embodiment, insole 101 may be built into the footwear as an integrated feature.

Figure 3:
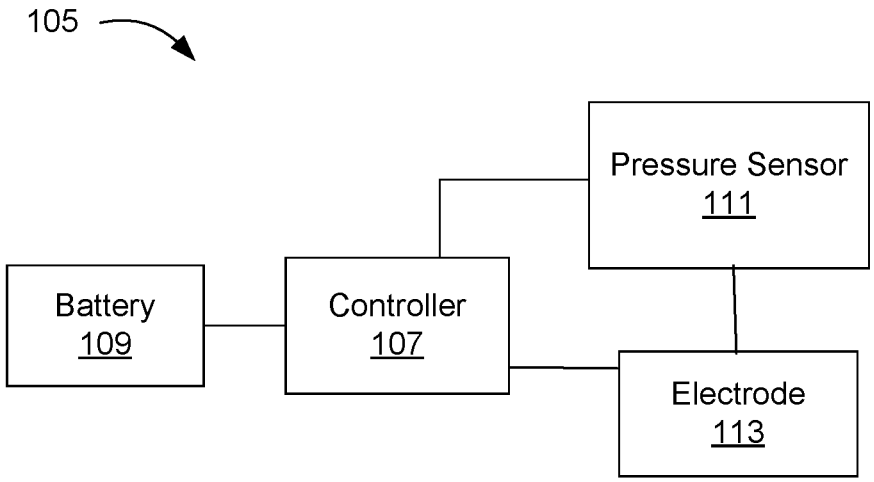
FIG. 3 is a schematic of an electrical stimulation system for use in the footwear insole of FIG. 1.
Figure 4:
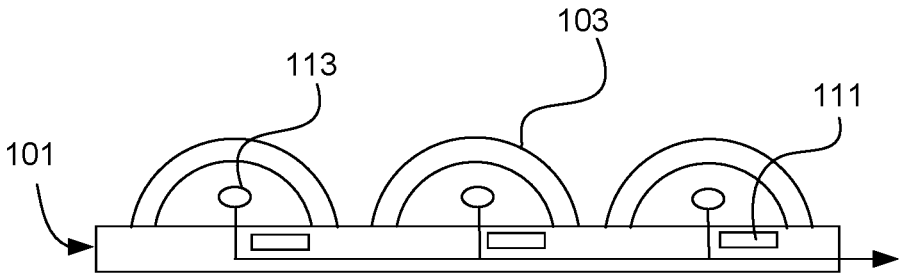
FIG. 4 is a partial enlarged side view of the electrical stimulation system of FIG. 3 in the footwear insole of FIG. 2.

Referring now also to FIGS. 3 and 4 in the drawings, an electrical stimulation system is shown. System 105 is configured to selectively apply an electrical stimulus to the user's foot. This is typically in response to pressure being applied to insole 101 but it may be operable for independent activation. System 105 includes a controller 107, a power supply 109, a pressure sensor 111, and an electrode 113. Power supply 109 provides power to initiate the stimulus. It is ideally rechargeable or may be set up to operate with disposable batteries. It may be plugged into an outlet and function with AC current power sources as well.

Controller 107 is configured to regulate the release of electrical current to electrodes 113. Controller 107 may regulate the intensity and/or the duration of the stimulus. It is preferred that controller 107 includes an input/output interface with communication capabilities. Controller 107 may be empowered to communicate with other remote electronic devices to regulate or adjust settings and functions. An example of a remote electronic device may be a cell phone or remote control.

Pressure sensor 109 is selectively located throughout locations in insole 101. Typically these are focused on areas of expected pressure applications. For example, the ball of the foot or the heel are known areas of potential pressure. One or more sensors may be used. In FIG. 4, sensor 109 is located at each pocket 103. This may be extreme or not necessary, but is serviceable to show that any number of sensors 109 may be used. The sensor 109 may be operable with one or more electrodes 113. The circuitry of system 105 may be such that each sensor 109 is operable with a particular routing of electrodes. System 105 is ideally operable with insole 101 when integrated into a footwear design as system 105 would need to be fully housed in the footwear.

In operation a user may insert a removable insole to any footwear for comfort and stimulus. A footwear may be configured to include insole 101 inside. Likewise, footwear may include insole 101 and system 105 to provide selective electrical stimulation to enhance foot health.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A footwear insole assembly, comprising:

an insole having an upper surface and a lower surface;

a plurality of pockets formed in the upper surface of the insole;

a plurality of pressure sensors located in the insole configured to detect a compressive force on the insole;

a plurality of electrodes located within at least one of the plurality of pockets and in communication with the plurality of pressure sensors; and a power supply configured to transmit power to the plurality of electrodes in response to detected pressure from the plurality of pressure sensors;

wherein the plurality of electrodes transmit electrical energy through the plurality of pockets in response to the detected pressure of the plurality of pressure sensors.

2. The assembly of claim 1, wherein the plurality of pockets are partially raised above the upper surface.

3. The assembly of claim 1, wherein the plurality of pockets are filled with a substance.

4. The assembly of claim 1, wherein the plurality of pressure sensors are located within at least one of the plurality of pockets.

5. The assembly of claim 1, wherein at least one of plurality of pressure sensors is externally located outside the plurality of pockets.

6. The assembly of claim 1, wherein a quantity of the plurality of electrodes are regulated by a singular pressure sensor in the plurality of pressure sensors.

7. The assembly of claim 1, wherein the insole is integrated into a shoe.

8. The assembly of claim 1, wherein the insole is removable from a shoe.

* * * * *